US005660312A

United States Patent [19]

Suzuki

[11] Patent Number: 5,660,312

[45] Date of Patent: Aug. 26, 1997

[54] STRAPS FOR BACKPACKING APPARATUS AND BACKPACKING APPARATUS

[75] Inventor: Shoji Suzuki, Tokyo, Japan

[73] Assignee: Suzusho Trading Co., Tokyo, Japan

[21] Appl. No.: 524,398

[22] Filed: Sep. 6, 1995

[30] Foreign Application Priority Data

Oct. 25, 1994 [JP] Japan ..... 6-284224

[51] Int. Cl.[6] ..... A45F 3/04

[52] U.S. Cl. ..... 224/627; 224/258

[58] Field of Search ..... 224/627, 628, 224/629, 631, 643, 651, 259, 577, 578, 579, 209, 258, 150, 913

[56] References Cited

U.S. PATENT DOCUMENTS

| | | | |
|---|---|---|---|
| 3,902,640 | 9/1975 | Gieben | 224/629 |
| 4,082,208 | 4/1978 | Lane, Jr. | 224/629 |
| 4,887,751 | 12/1989 | Lehman . | |
| 5,415,332 | 5/1995 | Kliot . | |
| 5,431,317 | 7/1995 | Kliot | 224/643 |

FOREIGN PATENT DOCUMENTS

| | | |
|---|---|---|
| 2693884 | 1/1994 | France . |
| 250606 | 9/1912 | Germany . |
| 45-27531 | 10/1970 | Japan . |
| 1-95127 | 6/1989 | Japan . |
| WO94/15496 | 7/1994 | WIPO . |

*Primary Examiner*—David J. Walczak
*Attorney, Agent, or Firm*—Baker & McKenzie

[57] ABSTRACT

A backpacking apparatus includes: a backpacking apparatus body in which an object is accommodated; and a strap for a backpacking apparatus which is connected to the backpacking apparatus body and is hung from a user's shoulder, the strap including a strap body and a length-adjusting member, the strap body having a length longer than a strap for a backpacking apparatus which is hung from another shoulder of the user, the length-adjusting member being provided on the strap body so as to adjust the length of the strap body by folding the strap body, the length-adjusting member being provided with an engaging/disengaging device having a first member and a second member. A longitudinally intermediate portion of the strap body is passed through the second member, and the engaging/disengaging device being adapted to be separated into the first member and the second member so as to partially cancel the folding of the strap body, thereby allowing the backpacking apparatus body resting on the back of the user to be moved toward a front side of a body of the user.

22 Claims, 14 Drawing Sheets

STRAPS FOR BACKPACKING APPARATUS AND BACKPACKING APPARATUS

BACKGROUND OF THE INVENTION

1. Field of the Invention

The present invention relates to straps for a backpacking apparatus and a backpacking apparatus using the straps.

2. Description of the Related Art

Backpacking apparatuses include bags of a type which are carried on one's back such as rucksacks, insecticide sprayers for farming while being carried on one's back, devices allowing an adult to carry an infant on his/her back, and the like.

For instance, as shown in FIG. 14, a conventional bag carried on one's back has two shoulder straps 2A and 2B attached to a bag body 1, and each of the shoulder straps 2A and 2B consists of an upper shoulder strap 3A or 3B and a lower shoulder strap 4A or 4B. The upper shoulder strap 3A or 3B has one end secured to an upper portion of the bag body 1. The lower shoulder strap 4A or 4B is comprised of a connecting strap 5A or 5B having an end portion secured to a lower portion of the upper shoulder strap 3A or 3B, a known adjusting member 6A or 6B provided on another end portion of the connecting strap 5A or 5B, and an adjusting strap 7A or 7B having one end secured to a lower portion of the bag body 1 and a substantially intermediate portion passed through the adjusting member 6A or 6B.

The above-described bag carried on one's back is very easy to carry, but when the goods accommodated in the bag body 1 are taken out, it is necessary to do so after the bag is temporarily put down from the back since the bag body 1 rests on the back. Such a bag is not necessarily convenient to use when an attempt is made to remove and put down the goods in the above-described manner while the user is walking or is in a crowd of people. In addition, at a time when the user carries such a bag accommodating heavy goods on his or her back, the user tightens the shoulder straps by adjusting the shoulder straps 2A and 2B to such a length that the shoulder straps are brought into close contact with the user's body. When resting on a field or mountain path, the user puts the bag down on a higher slope, a rock, or the like. When carrying the bag on his or her back afterwards, the user works his or her arms through the shoulder straps 2A and 2B. In that case, the user can easily work one of his or her arms through the shoulder strap 2A while bending or twisting his or her body. When working the other arm through the shoulder strap 2B, however, the user cannot easily do so by bending or twisting his or her body. This also applies to a case where an insecticide sprayer is carried on the user's back.

Meanwhile, a device allowing an adult to carry an infant on his/her back is adapted to be used for carrying an infant both at the bosom and on the back. However, when the carrying position is changed from the back to the bosom or vice versa, there is an inconvenience in that the infant must be temporarily put down, and the length of the strap must be adjusted.

SUMMARY OF THE INVENTION

Accordingly, it is an object of the present invention to provide straps for a backpacking apparatus and a backpacking apparatus which are capable of overcoming the above-described drawbacks of the conventional art.

In accordance with a first aspect of the present invention, there is provided a strap for a backpacking apparatus which is connected to a backpacking apparatus body and is hung from a user's shoulder, comprising: a strap body having a length longer than a strap for a backpacking apparatus which is hung from another shoulder of the user; and a length-adjusting member provided on the strap body so as to adjust the length of the strap body by folding the strap body, the length-adjusting member being provided with an engaging/disengaging device having a first member and a second member, wherein a longitudinally intermediate portion of the strap body is passed through the second member, and the engaging/disengaging device being adapted to be separated into the first member and the second member so as to partially cancel the folding of the strap body, thereby allowing the backpacking apparatus body resting on the back of the user to be moved toward a front side of a body of the user.

In accordance with a second aspect of the present invention, there is provided a backpacking apparatus comprising: a backpacking apparatus body in which an object is accommodated; and a strap for a backpacking apparatus which is connected to the backpacking apparatus body and is hung from a user's shoulder, the strap including a strap body and a length-adjusting member, the strap body having a length longer than a strap for a backpacking apparatus which is hung from another shoulder of the user, the length-adjusting member being provided on the strap body so as to adjust the length of the strap body by folding the strap body, the length-adjusting member being provided with an engaging/disengaging device having a first member and a second member, wherein a longitudinally intermediate portion of the strap body is passed through the second member, and the engaging/disengaging device being adapted to be separated into the first member and the second member so as to partially cancel the folding of the strap body, thereby allowing the backpacking apparatus body resting on the back of the user to be moved toward a front side of a body of the user.

In accordance with a third aspect of the present invention, there is provided a backpacking apparatus comprising: a backpacking apparatus body in which an object is accommodated; and a strap for a backpacking apparatus which is connected to the backpacking apparatus body and is hung from a user's shoulder, the strap including a strap body and a length-adjusting member, the strap body having a length longer than a strap for a backpacking apparatus which is hung from another shoulder of the user, the length-adjusting member being provided on the strap body so as to adjust the length of the strap body by folding the strap body, the length-adjusting member having an engaging/disengaging device and an engaging member, the engaging/disengaging device having a first member and a second member through which a longitudinally intermediate portion of the strap body is passed, the engaging member being provided at a lower portion of the backpacking apparatus body on another shoulder side of the user and being capable of engaging the second member, wherein the second member is provided in such a manner as to be capable of selectively engaging the first member and the engaging member, the folding of the strap body is partially canceled as the engagement is canceled, thereby allowing the backpacking apparatus body resting on the back of the user to be moved toward a front side of a body of the user.

In accordance with the first to third aspects of the present invention, in a state in which the backpacking apparatus body is carried on one's back, and the engaging/disengaging device is engaged, the length of the strap for a backpacking apparatus hung from the user's shoulder can be adjusted freely by the length-adjusting member. Consequently, the length of the strap can be adjusted freely so as to be optimally suited to the user.

If the engagement of the engaging/disengaging device is canceled with the backpacking apparatus body carried on one's back, the folding of the strap body is partially canceled, so that the strap is extended by the operation of moving the backpacking apparatus body toward the front side of the user's body, thereby allowing the backpacking apparatus body to be easily moved toward the front side of the user's body. At this time, since the strap is wound spirally around the neck, the armpit, the back, and the waist, the strap serves to stabilize the attitude of the backpacking apparatus body.

In accordance with the present invention, if the engaging/disengaging device is disengaged in a state in which the backpacking apparatus body is carried on one's back, the strap can be extended, so that the user is capable of moving the backpacking apparatus body from the back side toward the front side of the his or her body while standing. In addition, the user is capable of moving the backpacking apparatus body from the front side toward the back side of the his or her body. In addition, in a case where a backpacking apparatus accommodating heavy goods is carried on one's back, if the backpacking apparatus is carried on one's back with the engaging/disengaging device disengaged, the user can easily work his or her arm through the shoulder strap.

The above and other objects, features and advantages of the present invention will become more apparent from the following detailed description of the invention when read in conjunction with the accompanying drawings.

DESCRIPTION OF THE PREFERRED EMBODIMENTS

Figure 3:
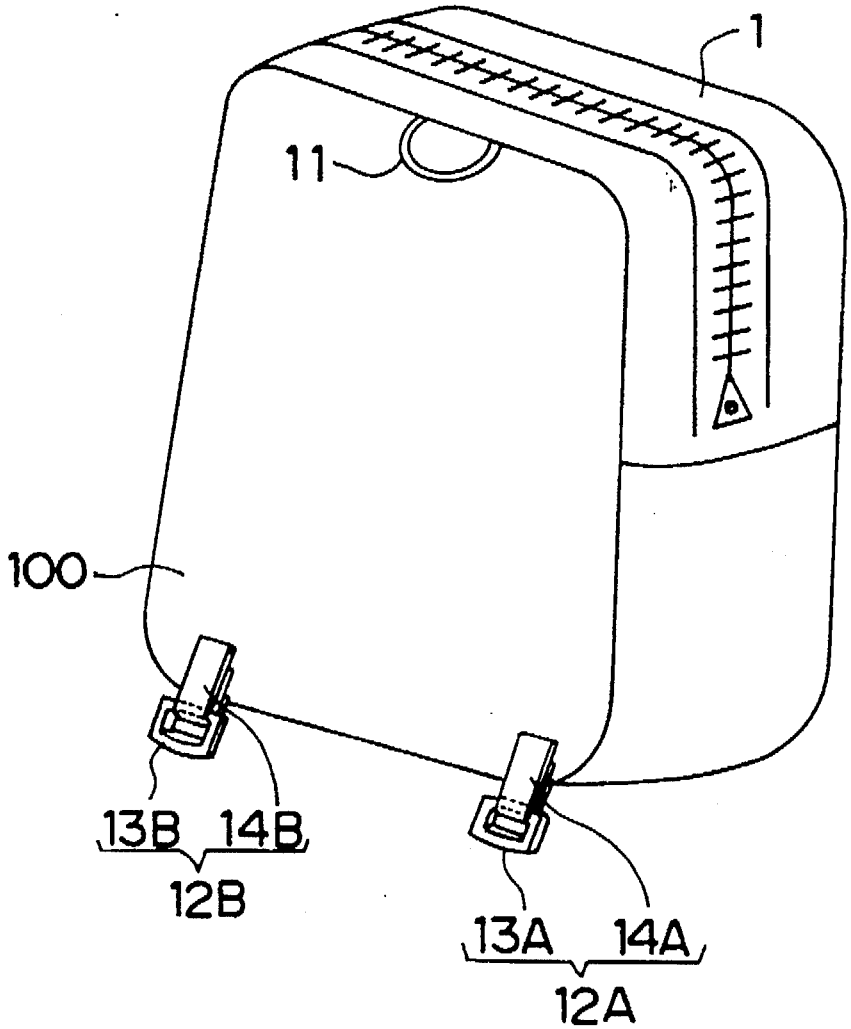
FIG. 3 is a perspective view illustrating the first embodiment of a backpacking apparatus body used in the backpacking apparatus in accordance with the present invention.
Figure 4A:
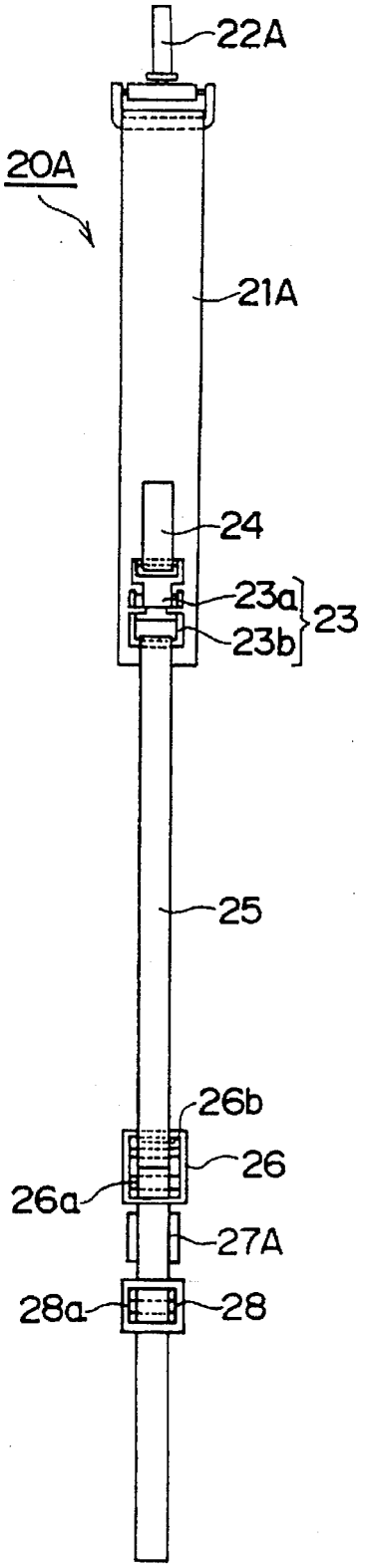
FIG. 4A is a front elevational view illustrating an example of one backpacking-apparatus strap in accordance with the present invention.
Figure 4B:
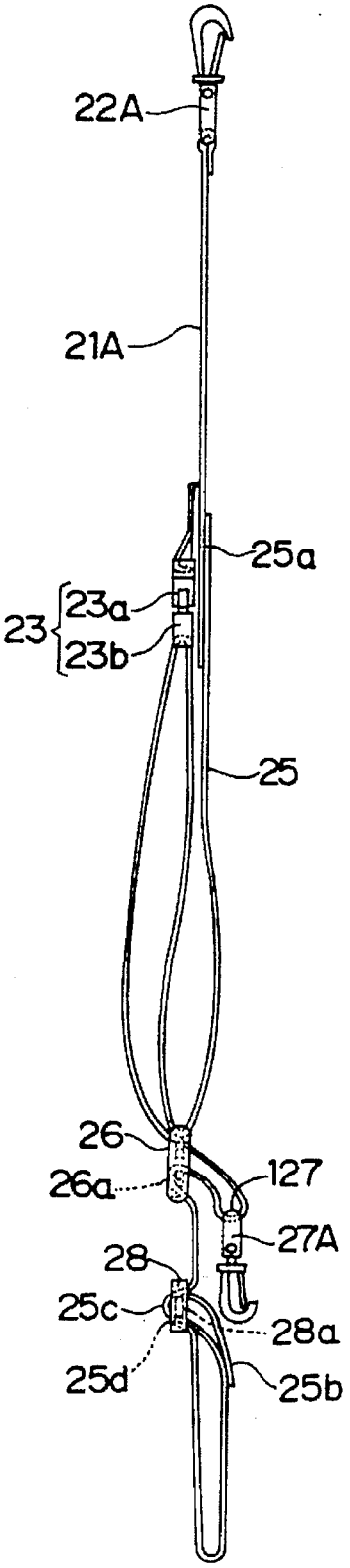
FIG. 4B is a side elevational view illustrating the backpacking-apparatus strap shown in FIG. 4A.

Hereafter, a description will be given of a first embodiment of the present invention with reference to FIGS. 1 to 6. As shown in FIG. 3, an upper attaching portion 11, which is constituted by a ring portion for detachably fixing one end of each of a pair of backpacking-apparatus straps 20A (shown in FIGS. 4A and 4B) and 20B (shown in FIGS. 5A and 5B), is provided on an upper portion of a surface 100 of a bag body 1 which faces the back of the user when the backpacking apparatus is in use. A pair of lower attaching portions 12A and 12B for detachably fixing the other ends or intermediate portion of each the backpacking-apparatus straps 20A and 20B are provided in the vicinities of lower transverse ends of the surface 100 of the bag body 1. The lower attaching portions 12A and 12B are arranged such that frames 13A and 13B are attached to the lower portion of the bag body 1 by means of attaching straps 14A and FIGS. 4A and 4B show one backpacking-apparatus strap 20A. A known hook 22A serving as an upper engaging member is attached to an upper end of an upper shoulder strap 21A. A first member **23*a* of a known engaging/disengaging device 23, which is capable of engaging with or disengaging from a surface side (i.e., one thicknesswise or major side surface), is fixed to a vicinity of a lower end of the upper shoulder strap 21A by means of a connecting strap 24. A second member 23*b* of the engaging/disengaging device 23 is provided in such a manner as to be capable of engaging with or disengaging from the first member 23*a*, and an elongated adjusting strap 25 is passed therethrough. One side of the adjusting strap 25 passed through the second member 23*b* of the engaging/disengaging device 23 is passed through an insertion hole 26*b* in a known length adjuster 26 and is turned back, and an end portion 25*a* of the turned-back portion of the adjusting strap 25 is secured to a rear side (i.e., the other thicknesswise surface or major side) of the upper shoulder strap 21A. The other side of the adjusting strap 25 passed through the second member 23*b* of the engaging/disengaging device 23 is passed through an insertion hole 26*b* of the length adjuster 26 from the obverse surface side (i.e., the left-hand surface in FIG. 4B) toward the reverse surface side (i.e., the right-hand surface in FIG. 4B), is then passed through a strap-attaching portion 127 of a known hook 27A serving as a lower engaging member, is passed around upper and lower sides of a strap-engaging portion 26*a* of the length adjuster 26, and is turned back. This portion of the adjusting strap 25 which is passed around upper and lower sides of the strap-engaging portion 26*a* is brought into frictional engagement with the strap-engaging portion 26*a*. Further, the adjusting strap 25 turned back at the strap-engaging portion 26*a* of the length adjuster 26 is passed through upper and lower sides of a strap-engaging portion 28*a* of a known adjuster 28 by forming turned-back portions 25***c* and 25*d* in the manner of a double fold, while another end portion 25*b* is secured to a portion close to the turned-back portion 25*d*.

Figure 5A:
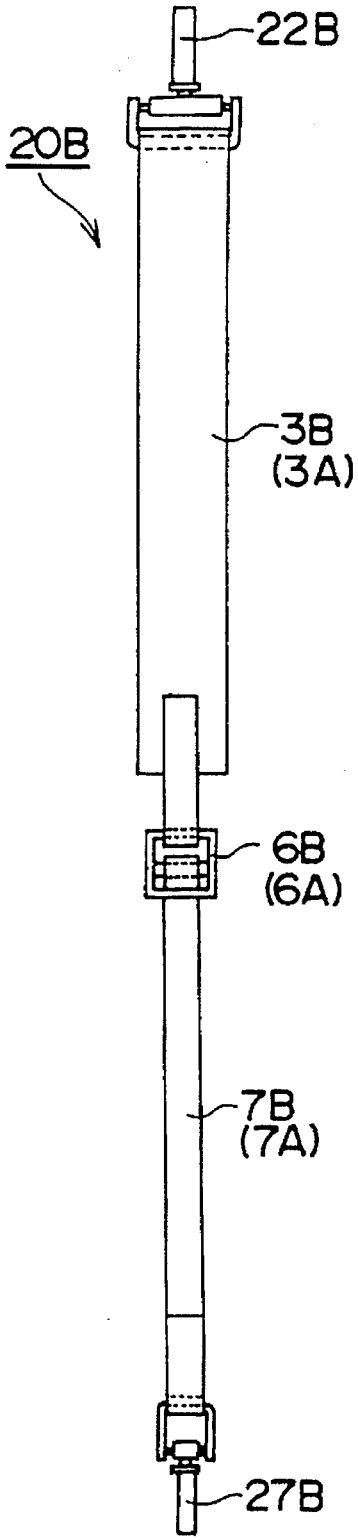
FIG. 5A is a front elevational view illustrating an example of another backpacking-apparatus strap in accordance with the present invention.
Figure 5B:
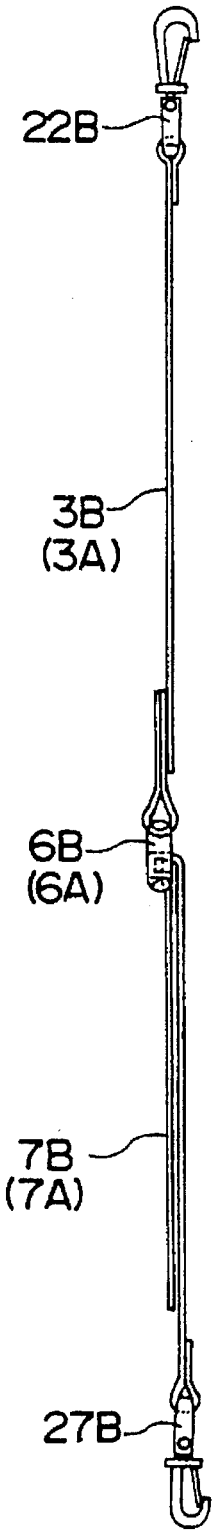
FIG. 5B is a side elevational view illustrating the backpacking-apparatus strap shown in FIG. 5A.
Figure 14:
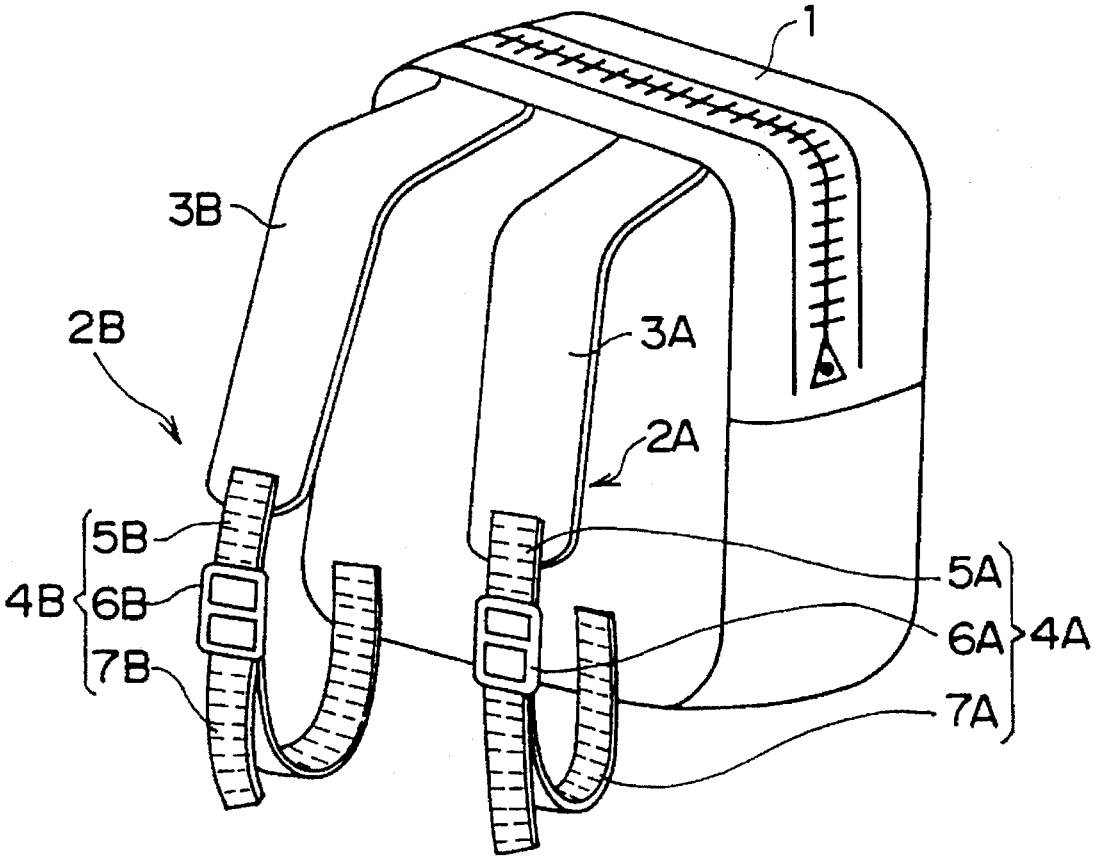
FIG. 14 PRIOR ART
FIG. 14 is a perspective view of a conventional bag of a type which is carried on one's back.

FIGS. 5A and 5B show the other backpacking-apparatus strap 20B. The backpacking-apparatus strap 20B differs from a conventional shoulder strap 2B (see FIG. 14) in the following aspects, so that identical or corresponding members or portions will be denoted by the same reference numerals, and a detailed description thereof will be omitted. Hooks 22B and 27B, which are similar to the hooks 22A and 27A shown in FIG. 4B, are respectively attached to an upper end of an upper shoulder strap 3B (3A) and one end of an adjusting strap 7B (7A).

Figure 1:
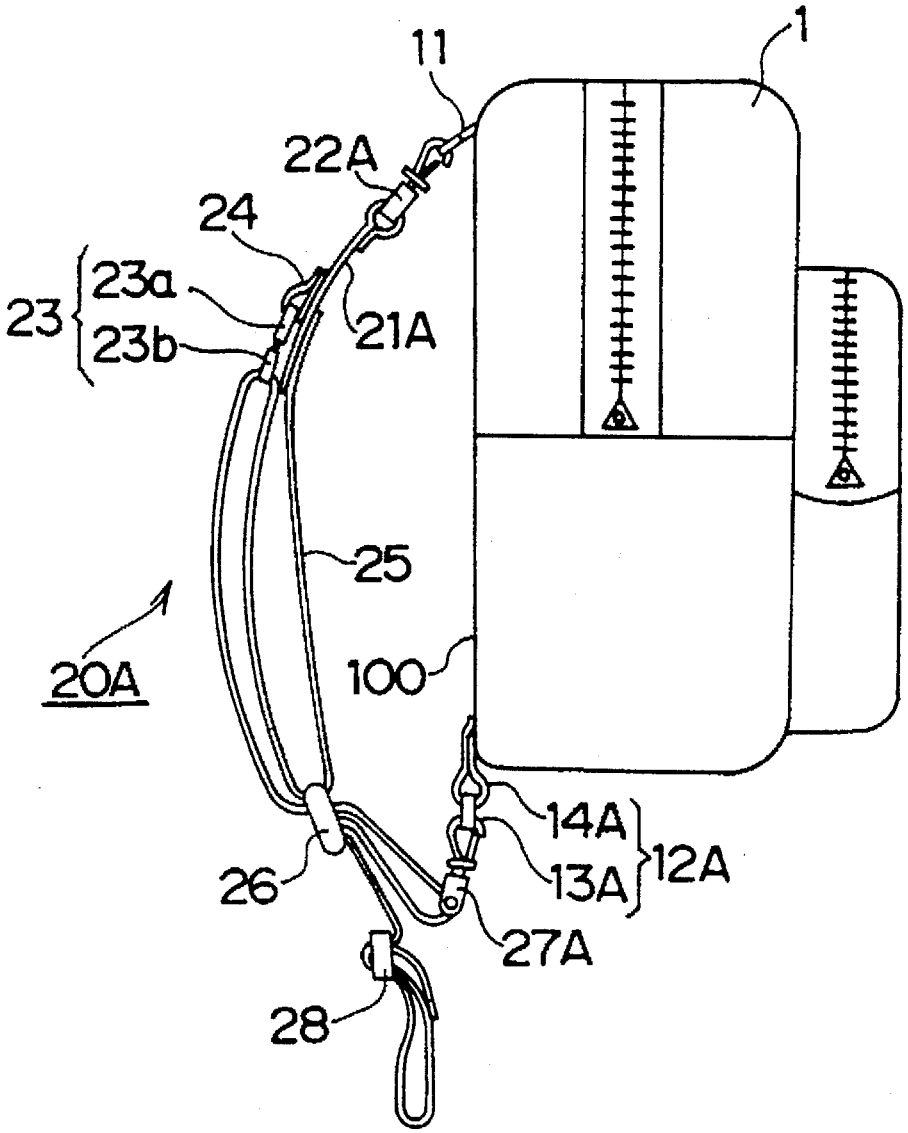
FIG. 1 is a side elevational view illustrating a first embodiment of a backpacking apparatus in accordance with the present invention.

As shown in FIG. 1, the hook 22A of the backpacking-apparatus strap 20A is engaged on the upper attaching portion 11, while the hook 27A is engaged on the ring 13A of the lower attaching portion 12A. In addition, although an illustration is not given, the hook 22B of the backpacking-apparatus strap 20B is engaged on the upper attaching portion 11 in such a manner as to be located on the left-hand side of the hook 22A, when the bag body 1 is viewed in the state shown in FIG. 3. Then, the hook 27B is engaged on the ring 13B of the lower attaching portion 12B. In this state, the user carries the bag body 1 on his or her back. If the length adjuster 26 is moved vertically, the length of the adjusting strap 25 between the hooks 22A and 27A can be adjusted freely. Consequently, the length of the backpacking-apparatus strap 20A can be adjusted freely so as to be optimally adjusted to the user. Incidentally, the adjuster 28 is provided to shorten the length of the adjusting strap 25 suspended from the length adjuster 26, and is not necessarily required.

Figure 2:
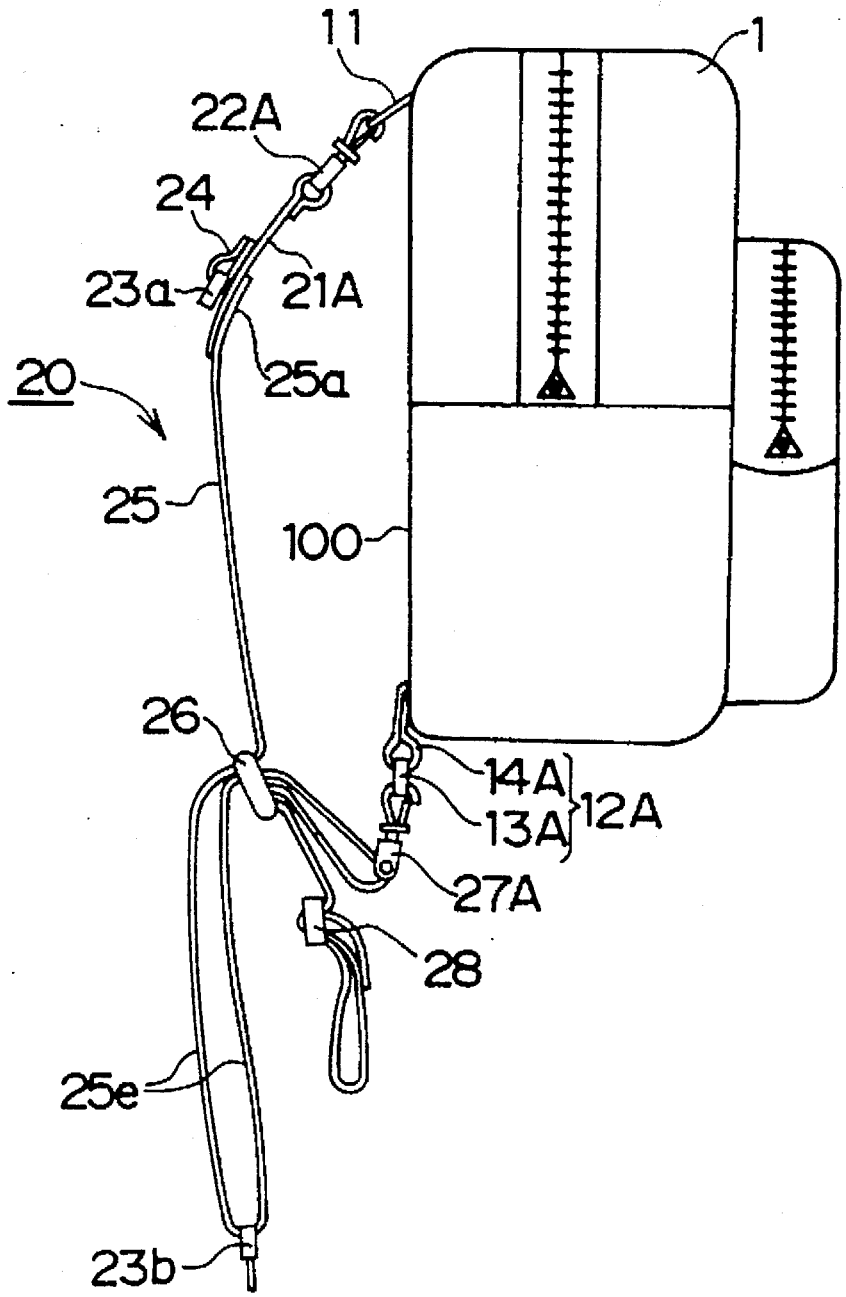
FIG. 2 is a side elevational view illustrating a state in which an engaging/disengaging device shown in FIG. 1 is disengaged.
Figure 6:
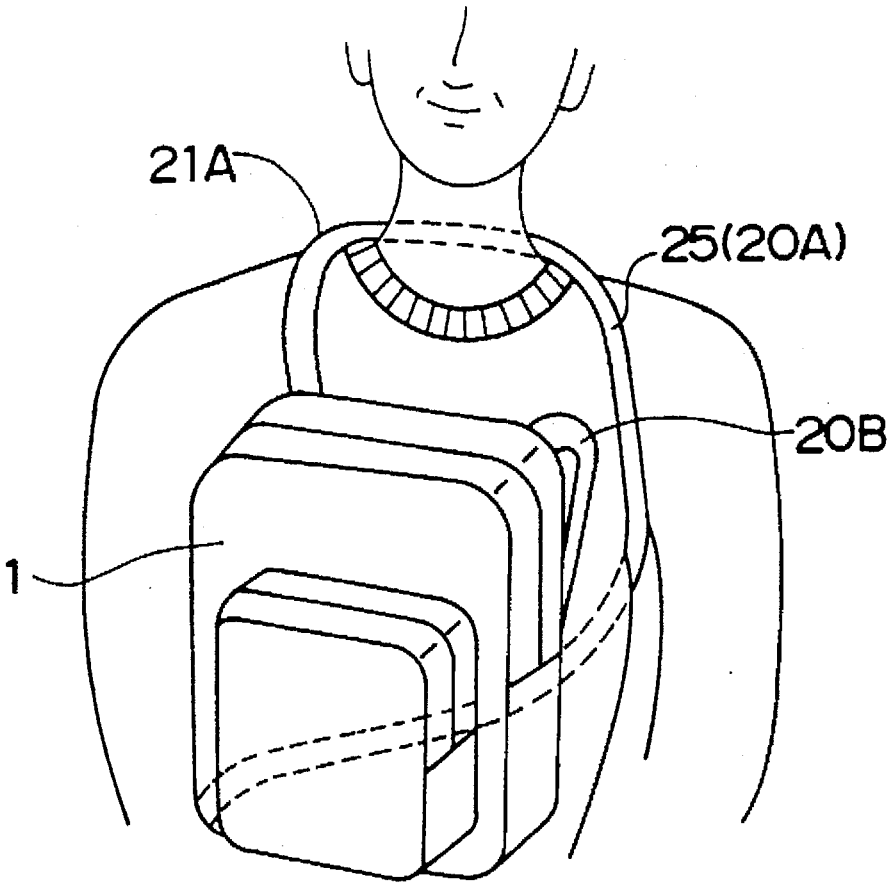
FIG. 6 is a diagram illustrating a state in which the backpacking apparatus is used.

When the accommodated goods are removed from the bag body 1 being carried on the user's back, as shown in FIG. 2, the first member 23*a* and the second member 23*b* of the engaging/disengaging device 23 are disengaged from each other. Then, if the bag body 1 is moved toward the front side of the user's body by pulling the other backpacking-apparatus strap 20B, and is removed from the shoulder, the upper shoulder strap 21A is pulled by this operation. Then, a portion 25*e* of the adjusting strap 25 suspended from the length adjuster 26 becomes short. Namely, since the length of the adjusting strap 25 between the end portion 25*a* of the adjusting strap 25 and the length adjuster 26 is extended, the user is able to easily move the bag body 1 toward the front side of his or her body while the backpacking-apparatus strap 20B is being suspended from his or her shoulder. Consequently, since the adjusting strap 25 is wound spirally around the neck, the armpit, the back, and the waist, as shown in FIG. 6, the adjusting strap 25 produces the effect of stabilizing the attitude of the bag body 1, thereby allowing the user to take out the goods accommodated in the bag easily with his or her both hands. In addition, in a case where heavy goods are accommodated in the bag and are carried on the user's back, this arrangement is suitable when the heavy bag is carried on one's back after taking a rest. Namely, if the engaging/disengaging device 23 is set in a disengaged state, the backpacking-apparatus strap 20A can be extended, so that the user is able to easily work his or her arms through the backpacking-apparatus straps 20A and 20B. Further, if the backpacking-apparatus strap 20B is hung on the shoulder (the one on the right as viewed in FIG. 6) on which the backpacking-apparatus strap 20A is hung, the bag body 1 is brought into close contact with the user's body, thereby making it possible to stabilize the attitude of the bag body 1.

In addition, in this embodiment, the hooks 22A, 22B and 27A, 27B are respectively attached to the both ends of the backpacking-apparatus straps 20A and 20B, so that the backpacking apparatus can be used for both left-handed and right-handed persons. Namely, although the above-description has been given of a case in which the backpacking apparatus is applied to a right-handed person, in the case of a left-handed person, the hook 22A of the backpacking-apparatus strap 20A is attached to the upper attaching portion 11 of the bag body 1 so as to be located on the left-hand side when the bag body 1 is viewed in the state shown in FIG. 3, while the hook 22B of the backpacking-apparatus strap 20B is attached thereto so as to be located on the right-hand side. In addition, the hook 27A of the backpacking-apparatus strap 20A is attached to the lower attaching portion 12B, while the hook 27B of the backpacking-apparatus strap 20B is attached to the lower attaching portion 12A.

Thus, if the hooks 22A, 22B and 27A, 27B are attached to both ends of the backpacking-apparatus straps 20A and 20B, a proper backpacking-apparatus strap can be attached in a manner suited to the hand more skillful than the other irrespective of the left-handed or right-handed person. In addition, only the backpacking-apparatus strap 20A shown in FIGS. 4A and 4B may be sold. Generally, the upper attaching portion 11 is already provided on the existing bag body 1, so that the backpacking-apparatus strap 20A can be used if the lower attaching portion 12A is attached to the lower portion of the bag body 1.

It should be noted that the upper attaching portion 11 and the rings 13A and 13B of the lower attaching portions 12A and 12B are not limited to those given in the above-described embodiment, and the same hooks as the hooks 22A, 22B, 27A, and 27B serving as the upper engaging members and the lower engaging members may be used. In this case, the same rings as the rings 13A and 13B may be used in place of the hooks 22A, 22B, 27A, and 27B.

In addition, as a modification of the above-described first embodiment, one of the first member 23*a* and the second member 23*b* of the engaging/disengaging device 23 shown in FIG. 1 may be used as each of the upper attaching portion 11 and the rings 13A and 13B of the lower attaching portions 12A and 12B. In this modification, the other one of the first member 23*a* and the second member 23*b* of the engaging/disengaging device 23 may be used in place of each of the hooks 22A, 22B, 27A, and 27B.

Figure 7:
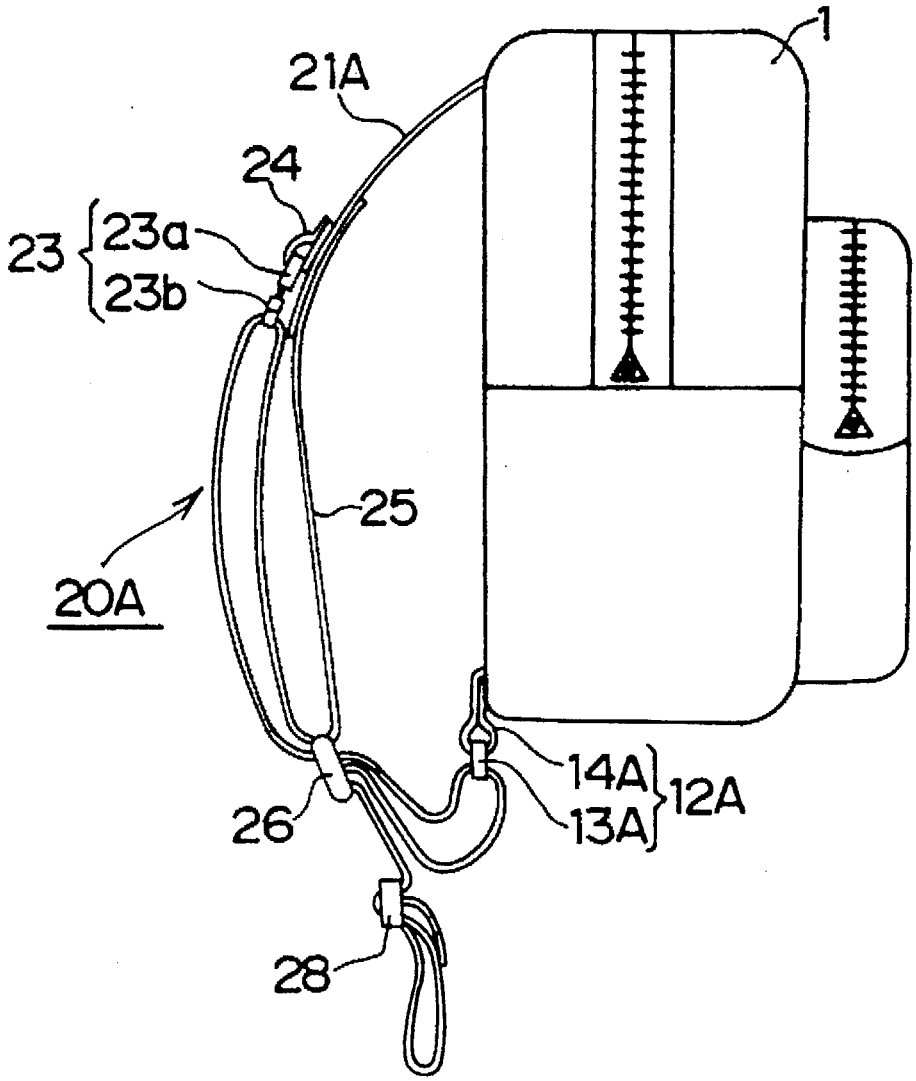
FIG. 7 is a side elevational view illustrating a second embodiment of the backpacking apparatus in accordance with the present invention.
Figure 8:
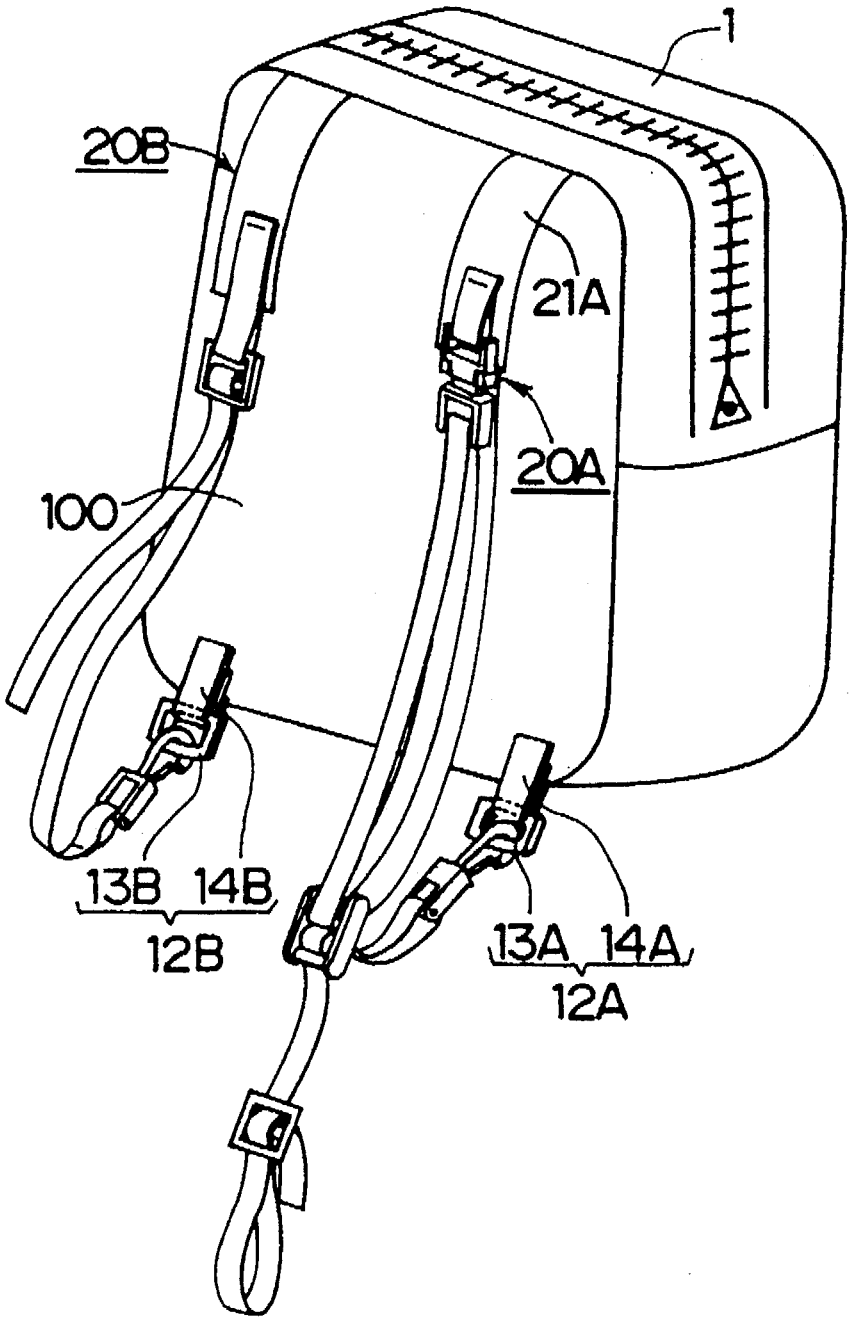
FIG. 8 is a perspective view of the backpacking-apparatus shown in FIG. 7.

FIGS. 7 and 8 show a second embodiment of the bag of a type carried on one's back in accordance with the present invention. In the first embodiment, the backpacking-apparatus straps 20A and 20B are detachably attached to the bag body 1. In the second embodiment, on the other hand, the hooks 22A, 22B, 27A, and 27B used in the first embodiment are omitted, and the backpacking-apparatus straps 20A and 20B are fixedly attached to the bag body 1. Namely, as for one backpacking-apparatus strap 20A, the upper end of the upper shoulder strap 21A is fixed (by sewing, for example) directly to the upper portion of the bag body 1, and the portion of the adjusting strap 25 passed through the hook 27A shown in FIG. 1 is directly passed through the ring 13A. Meanwhile, as for the other backpacking-apparatus strap 20B, it upper and lower ends are respectively secured to the upper and lower portions of the bag body 1 in the same way as the conventional shoulder strap 2B shown in FIG. 14. In this arrangement as well, if the first member 23*a* and the second member 23*b* of the engaging/disengaging device 23 are separated from each other, the adjusting strap 25 can be extended in the same way as in the first embodiment. Therefore, in the same way as the first embodiment, the bag body 1 can be moved toward the front side of the user's body such that the backpacking-apparatus strap 20A is suspended from his or her neck.

Figure 9:
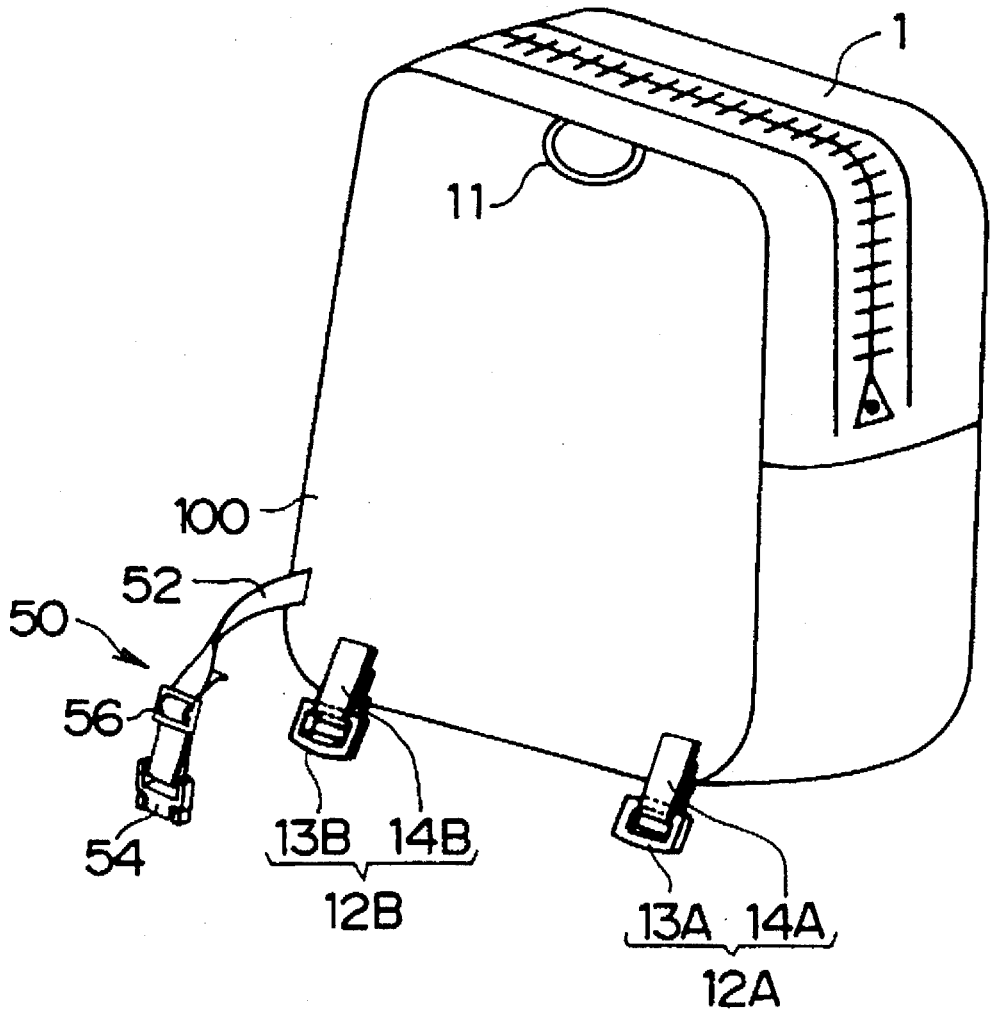
FIG. 9 is a perspective view illustrating a form of the backpacking apparatus body used in the backpacking apparatus in accordance with a third embodiment of the present invention.
Figure 10:
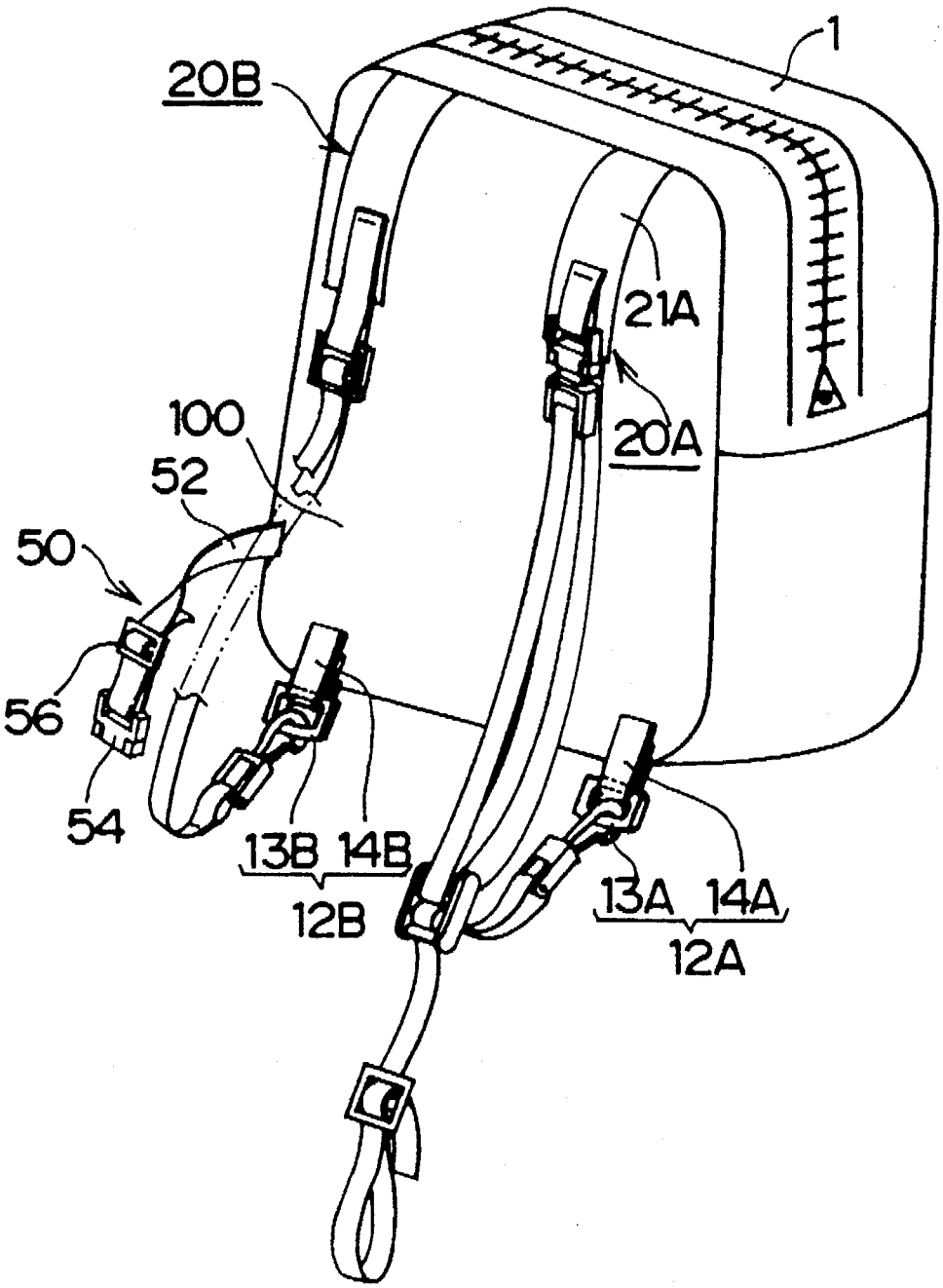
FIG. 10 is a perspective view illustrating another form of the backpacking apparatus in accordance with the third embodiment of the present invention.

FIGS. 9 and 10 show a third embodiment of the bag of the type carried on one's back in accordance with the present invention. In this bag of the type carried on one's back, an adjusting-strap engaging member 50 serving as an engaging member is secured to a vicinity of the position of the lower attaching portion 12B which is provided on the transversely opposite side of the back body 1 with respect to the attaching position of the lower attaching portion 12A where the backpacking-apparatus strap 20A shown in FIG. 4A is fixed. Since the other arrangements are similar to those of the above-described first and second embodiments, a description thereof will be omitted.

In FIGS. 9 and 10, the adjusting-strap engaging member 50 is provided with a waist strap member 52 having one end sewn onto the bag body 1 and an engaging/disengaging device 54 which is fitted on the waist strap member 52 and is capable of engaging the second member 23*b* of the engaging/disengaging device 23 used in the first and second embodiments. As this engaging/disengaging device 54, the same one as the first member 23*a* of the engaging/disengaging device 23 is used. A portion of the waist strap member 52 located in the vicinity of another end thereof and an intermediate portion between the engaging/disengaging device 54 and one end of the waist strap member 52 are superposed one on top of the other, and are passed through a length adjuster 56. As the length adjuster 56, the same one as the known adjuster 28 shown in FIG. 4A is used. Incidentally, the engaging/disengaging device 54 and the length adjuster 56 are not limited to the above-described members, and it is possible to use other members insofar as they are provided with similar functions.

In the above-described arrangement, as the second member 23*b* of the engaging/disengaging device 23 and the engaging/disengaging device 54 engage each other, the position of the bag body 1 at and near the user's waist can be held stably. Further, if the engagement is canceled, it is possible to obtain an advantage similar to the one obtained when the engagement between the first member 23*a* and the second member 23*b* of the engaging/disengaging device 23 is canceled, as described in the first and second embodiments.

Figure 11:
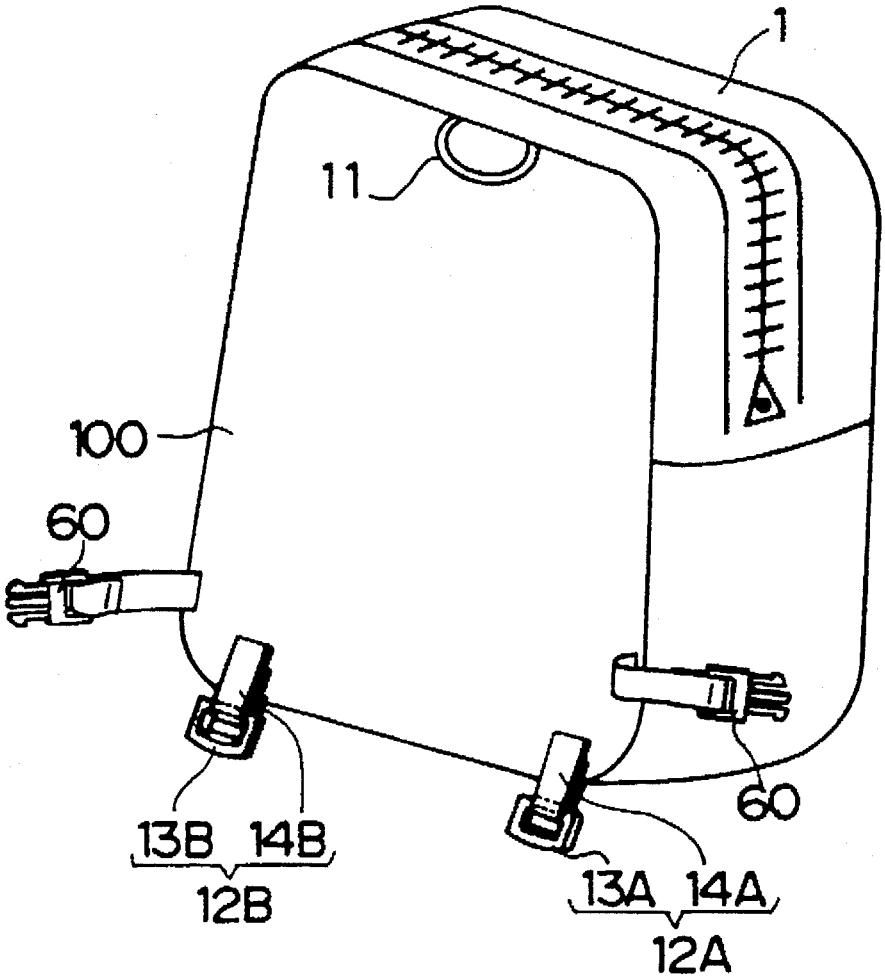
FIG. 11 is a perspective view illustrating a modification of the form shown in FIG. 9.
Figure 12:
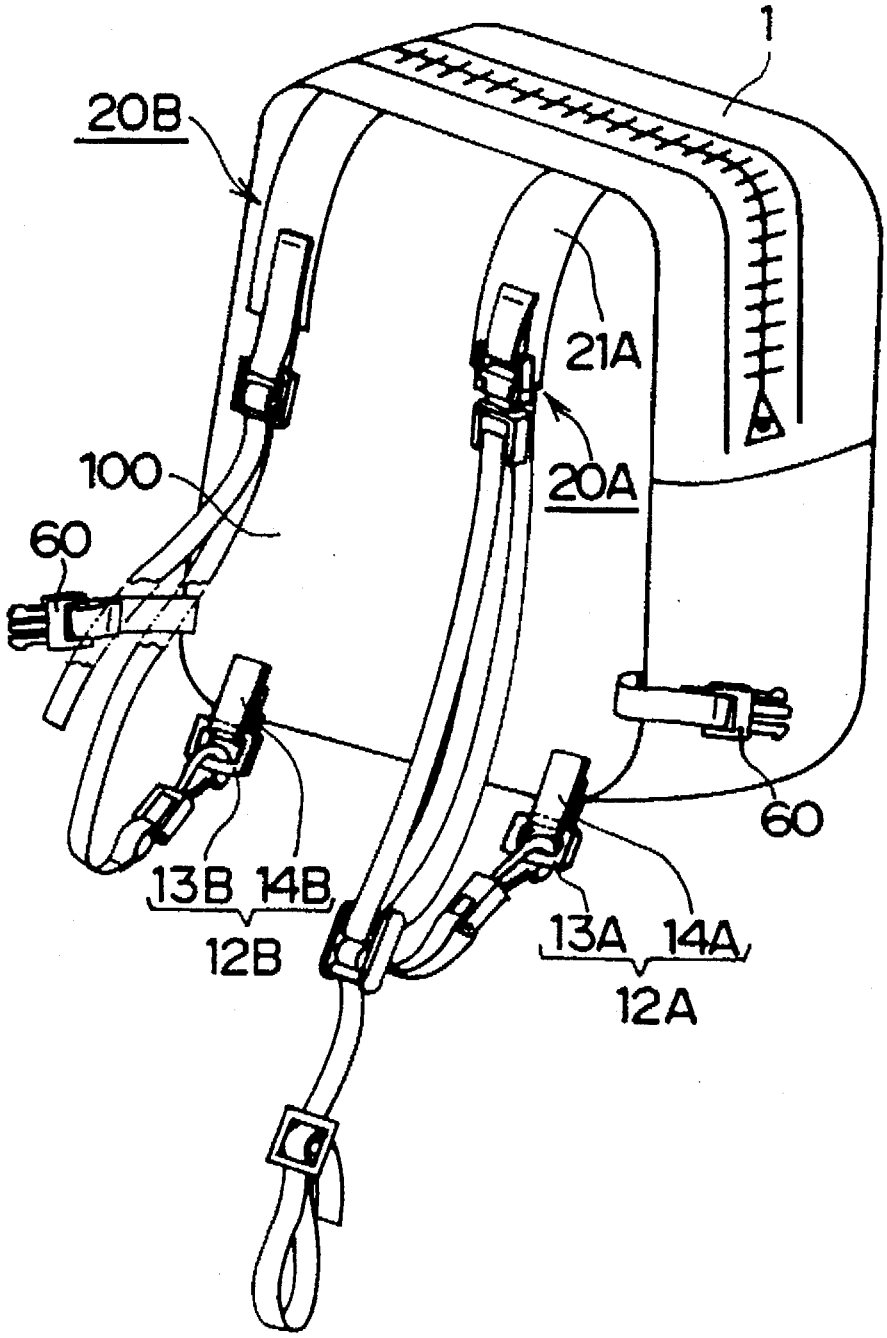
FIG. 12 is a perspective view illustrating a modification of the form shown in FIG. 10.
Figure 13:
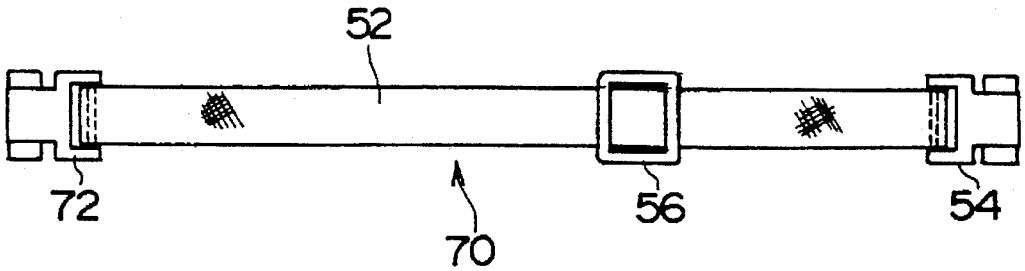
FIG. 13 is a plan view illustrating an adjusting-strap engaging member used in the forms shown in FIGS. 11 and 12.

In addition, although, in this embodiment, one end of the waist strap member 52 is sewn onto the bag body 1, the arrangement is not limited to the same. For example, it is possible to use an adjusting-strap engaging member 70 in which a second engaging/disengaging member 72 similar to the engaging/disengaging device 54 is attached to one end of the adjusting-strap engaging member 50 shown in FIGS. 9 and 10, as shown in FIG. 13. In this case, it suffices if a pair of first engaging members 60 which are each similar to the first member of the engaging/disengaging device 23 shown in FIG. 4A are respectively provided in the vicinities of the positions where the lower attaching portions 12A and 12B are attached, as shown in FIGS. 11 and 12. In this arrangement, as the second engaging/disengaging member 72 engages the first engaging/disengaging member 60, the position of the bag body 1 at and near the user's waist can be held stably. Further, if the engagement is canceled, it is possible to obtain an advantage similar to the one obtained when the engagement between the first member 23*a* and the second member 23*b* of the engaging/disengaging device 23 is canceled, as described in the first and second embodiments. In addition, in the form in which the adjusting-strap engaging member 70 is used, since the adjusting-strap engaging member 70 can be selectively attached with respect to either the lower attaching portion 12A or 12B, there is an advantage in that the attaching position of the adjusting-strap engaging member 70 can be changed in correspondence with the attaching position of the backpacking-apparatus strap 20A (i.e., the position for hanging from the left shoulder or the position for hanging from the right shoulder), in the same way as in the form in which the backpacking-apparatus straps 20A and 20B shown in FIGS. 4A and 5A are used.

Although, in the above embodiments, a description has been given of the case where the present invention is applied to the bag of the type which is carried on one's back, the present invention is widely applicable to other backpacking apparatus including insecticide sprayers, devices allowing an adult to carry an infant on his/her back, and the like. In the case where the present invention is applied to the insecticide sprayer, the insecticide sprayer which is carried on one's back can be easily moved from the back toward the front side of the user's body and vice versa in the same way as the bag of the type carried on one's back. Also, it is easy to carry the insecticide in a put-down state onto one's back. In the case where the present invention is applied to the device allowing an adult to carry an infant on his/her back, the position in which an infant is carried can be changed from the back to the bosom or vice versa without temporarily putting down the infant. In addition, although, in the above-described embodiments, one end portion 25*a* of the adjusting strap 25 is secured to the lower end of the upper shoulder strap 21A, the upper shoulder strap 21A and the adjusting strap 25 may be formed of a single strap. In other words, it suffices if the end portion 25*a* of the adjusting strap 25 is elongated by the length of the upper shoulder strap 21A, and the hook 22A is attached to the end of the adjusting strap 25, or the end of the adjusting strap 25 is fixed directly to the bag body 1. Further, although the adjusting strap 25 is brought into frictional engagement with the strap-engaging portion 26*a* of the length adjuster 26 after being passed through the hook 27A or the ring 13A, the adjusting strap 25 may be frictionally engaged by being passed through a frictional retainer of a different type.

What is claimed is:

1. A strap for a backpacking apparatus adapted to be connected to a backpacking apparatus body and hung from a user's shoulder, comprising:

a strap body ; and a length-adjusting member provided on said strap body so as to adjust the length of said strap body by folding said strap body, said length-adjusting member being provided with an engaging/disengaging device having a first member and a second member, said second member being provided so that a longitudinally intermediate portion of said strap body movably passes therethrough, wherein said engaging/disengaging device allows at least partial unfolding of the folding of said strap body by releasing the engagement of said first member and said second member, thereby allowing the backpacking apparatus body resting on the back of the user to be moved toward a front side of a body of the user.

2. A strap for a backpacking apparatus according to claim 1, wherein said length-adjusting member has a length-adjusting device through which said strap body is passed, said strap body being folded over itself a plurality of times between said length-adjusting device and said engaging/disengaging device.

3. A strap for a backpacking apparatus according to claim 1, further comprising:

an upper engaging member provided on an end portion of said strap body and adapted to engage an upper attaching portion provided on an upper portion of the backpacking apparatus body.

4. A strap for a backpacking apparatus according to claim 1, further comprising:

a lower engaging member through which said strap body is inserted and which is adapted to engage a lower attaching portion provided on a lower portion of the backpacking apparatus body.

5. A strap for a backpacking apparatus according to claim 1, wherein one end of said strap body is sewn onto an upper attaching portion provided on an upper portion of the backpacking apparatus body.

6. A backpacking apparatus comprising:

a backpacking apparatus body in which an object is accommodated; and a strap for the backpacking apparatus which is connected to said backpacking apparatus body and is hung from a user's shoulder, said strap including a strap body and a length-adjusting member, said length-adjusting member being provided on said strap body so as to adjust the length of said strap body by folding said strap body, said length-adjusting member being provided with an engaging/disengaging device having a first member and a second member, said second member being provided so that a longitudinally intermediate portion of said strap body movably passes therethrough, wherein said engaging/disengaging device allows at least partial unfolding of the folding of said strap body by releasing the engagement of said first member and said second member, thereby allowing said backpacking apparatus body resting on the back of the user to be moved toward a front side of a body of the user.

7. A backpacking apparatus according to claim 6, wherein said length-adjusting member has a length-adjusting device through which said strap body is passed, said strap body is folded over itself a plurality of times between said length-adjusting device and said engaging/disengaging device.

8. A backpacking apparatus according to claim 7, wherein said length-adjusting device has a strap-engaging portion, and said strap-engaging portion changes the length of said strap body between said length-adjusting device and said engaging/disengaging device as said strap body is passed through said strap-engaging portion.

9. A backpacking apparatus according to claim 6, further comprising:

an upper engaging member provided on an end portion of said strap body engaging an upper attaching portion provided on an upper portion of said backpacking apparatus body.

10. A backpacking apparatus according to claim 6, further comprising:

a lower engaging member fitted on said strap body engaging a lower attaching portion provided on a lower portion of said backpacking apparatus body.

11. A backpacking apparatus according to claim 6, wherein one end of said strap body is sewn onto an upper attaching portion provided on an upper portion of said backpacking apparatus body.

12. A backpacking apparatus according to claim 6, wherein said strap body includes a shoulder strap and a length-adjusting strap, and said first member is fixed to said shoulder strap.

13. A backpacking apparatus comprising:

a backpacking apparatus body in which an object is accommodated; and a strap for said backpacking apparatus which is connected to said backpacking apparatus body and is adapted to be hung from a user's shoulder, said strap including a strap body and a length-adjusting member, another strap connected to said backpacking apparatus body spaced from said strap body and adapted to be hung from another shoulder of the user, said strap body having a length longer than the length of said other strap, said length-adjusting member being provided on said strap body so as to adjust the length of said strap body by folding said strap body, said length-adjusting member having an engaging/disengaging device and an engaging member, said engaging/disengaging device having a first member and a second member through which a longitudinally intermediate portion of said strap body is movably passed, said engaging member being provided at a lower portion of said backpacking apparatus body on the same side of said backpacking apparatus as said other strap and being capable of engaging said second member, wherein said second member is provided in such a manner as to be capable of selectively engaging said first member and said engaging member, and wherein the folding of said strap body is partially unfolded as engagement of said second member, said first member and said engaging member is released, thereby allowing said backpacking apparatus body resting on the back of the user to be moved toward a front side of a body of the user.

14. A backpacking apparatus according to claim 13, wherein said length-adjusting member has a length-adjusting device through which said strap body is passed, said strap body being folded over itself a plurality of times between said length-adjusting device and said engaging/disengaging device.

15. A backpacking apparatus according to claim 14, wherein said length-adjusting device has a strap-engaging portion, and said strap-engaging portion changes the length of said strap body between said length-adjusting device and said engaging/disengaging device as said strap body is passed through said strap-engaging portion.

16. A backpacking apparatus according to claim 13, further comprising:

an upper engaging member provided on an end portion of said strap body engaging an upper attaching portion provided on an upper portion of said backpacking apparatus body.

17. A backpacking apparatus according to claim 13, further comprising:

a lower engaging member fitted on said strap body engaging a lower attaching portion provided on a lower portion of said backpacking apparatus body.

18. A backpacking apparatus according to claim 13, wherein one end of said strap body is sewn onto an upper attaching portion provided on an upper portion of said backpacking apparatus body.

19. A backpacking apparatus according to claim 13, wherein said strap body includes a shoulder strap and a length-adjusting strap, and said first member is fixed to said shoulder strap.

20. A backpacking apparatus according to claim 13, wherein said engaging member has a waist strap member, and said waist strap member is provided such that a length thereof is variable.

21. A strap for a backpacking apparatus which when connected to the backpacking apparatus is hung from a user's shoulder, comprising:

a strap body; and an engaging/disengaging device having a first member connected to said strap body and a second member connected to an intermediate section of said strap body spaced from said first member with said strap movable with respect to said second member, said first and second members being releasably engagable with each other, said intermediate section of said strap being at least partially folded upon itself when said first and second members are engaged to provide a first effective length of said strap body, and when said first and second members are released from engagement said intermediate section of said strap body being movable relative to said second member to allow at least partial unfolding of said intermediate section of said strap body to provide a second effective length of said strap body longer than said first effective length.

22. A strap for a backpacking apparatus, comprising:

a strap body;

an engaging/disengaging device; and a length-adjusting device;

said engaging/disengaging device having a first member fixedly connected to said strap body and a second member movably connected to said strap body spaced from said first member with said strap body movable with respect to said second member, said first and second members being releasably engageable with each other;

said length-adjusting device being connected to said strap body between said first and second members such that said strap body movable with respect to said length-adjusting device; said strap body between said first and second members being folded upon itself at least partially when said first and second members are engaged;

said strap body between said first and second members being unfoldable at least partially when said first and second members are not engaged to each other to elongate said strap body as compared to when said first and second members are engaged with each other.

* * * * *